US007755302B2

(12) United States Patent
Cheng et al.

(10) Patent No.: US 7,755,302 B2
(45) Date of Patent: Jul. 13, 2010

(54) MULTI-MODULATION MODE LED DRIVING CIRCUIT

(75) Inventors: Ying-Nan Cheng, Taipei Hsien (TW); Chin-Biau Chung, Taipei Hsien (TW)

(73) Assignee: Zippy Technology Corp., Hsin-Tien, Taipei Hsien (TW)

( * ) Notice: Subject to any disclaimer, the term of this patent is extended or adjusted under 35 U.S.C. 154(b) by 305 days.

(21) Appl. No.: 12/062,964

(22) Filed: Apr. 4, 2008

(65) Prior Publication Data

US 2009/0251079 A1 Oct. 8, 2009

(51) Int. Cl.
*H05B 37/02* (2006.01)

(52) U.S. Cl. ..... 315/307; 315/297; 315/360

(58) Field of Classification Search ..... 315/209 R, 315/247, 291, 294, 297, 299, 307, 308, 360; 362/227, 230, 276, 800

See application file for complete search history.

(56) References Cited

U.S. PATENT DOCUMENTS 7,145,295 B1 * 12/2006 Lee et al. ..... 315/291
7,557,520 B2 * 7/2009 Chen et al. ..... 315/291
7,592,756 B1 * 9/2009 Wu et al. ..... 315/307

* cited by examiner

*Primary Examiner*—Douglas W Owens
*Assistant Examiner*—Tung X Le
(74) *Attorney, Agent, or Firm*—Muncy, Geissler, Olds, & Lowe, PLLC

(57) ABSTRACT

The present invention discloses a multi-modulation mode LED driving circuit, which controls an inverter to perform energy conversion to drive at least one LED. The driving circuit of the present invention is modulated by a timing control signal containing an on time and a standby time. In the present invention, a varying-amplitude modulation energy is added to the standby time. In the present invention, the start and end of the on time respectively have a gradually-ascending interval and a gradually-descending interval, and/or the start and end of the standby time respectively have a gradually-descending interval and a gradually-ascending interval. In the present invention, two or more different cycles are mixed to generate high-reliability and wide-dynamical range modulation modes, which can make an energy conversion unit and a rear-end LED group operate in reliable ranges of some performance characteristics.

6 Claims, 5 Drawing Sheets

MULTI-MODULATION MODE LED DRIVING CIRCUIT

FIELD OF THE INVENTION

The present invention relates to a multi-modulation mode LED (Light Emitting Diode) driving circuit, particularly to a LED driving circuit, which can modulate the period and energy level of driving power.

BACKGROUND OF THE INVENTION

Refer to FIG. 1, the conventional power control technology, such as the dimming control, usually adopts an ON-OFF Interval modulation method, wherein the ratio of an ON interval and an OFF interval is modulated to vary the energy output. It is the most frequently-used method. In the above-mentioned method, there is an EDR (Excitation Dynamical Ratio) defined as $$\approx \frac{E_1(\text{energy of ON interval})}{E_2(\text{energy of OFF interval})}, \quad \text{(Equation 1)}$$

and the traditional EDR is $$\frac{E_1}{E2 \approx 0} \Rightarrow \infty.$$

The above-mentioned equation will attain an EDR of infinity, and the effect of the infinite EDR can be explained with the following analogy example: a steel wire is bent by 90 degrees, and restored to be a straight wire, and then bent by 90 degrees again; after the above-mentioned steps are repeated many times, the steel wire will be fractured finally; if the steel wire is bent by only 10 degrees, much more times of bending is required to fracture the steel wire. Similarly, when LED works in two extremities, it will age faster. Therefore, the conventional power control technology of too high an EDR greatly affects the lifetime of LED.

SUMMARY OF THE INVENTION

The primary objective of the present invention is to overcome the above-mentioned problem. In the present invention, a gradient amplitude is used in a turn-on interval $T_{ON}$ to control an inverter lest too high an EDR appear. Thereby, the inverter and LED can be effectively controlled to prevent LED from aging fast.

To achieve the above-mentioned objective, the present invention discloses a multi-modulation mode LED driving circuit, which controls an inverter to perform energy conversion to drive at least one LED. The driving circuit of the present invention is modulated by a timing control signal containing an on time and a standby time. In the present invention, a varying-amplitude modulation energy is added to the standby time. In the present invention, the start and end of the on time respectively have a gradually-ascending interval and a gradually-descending interval, and/or the start and end of the standby time respectively have a gradually-descending interval and a gradually-ascending interval. In the present invention, two or more different cycles are mixed to generate high-reliability and wide-dynamical range modulation modes, which can make an energy conversion unit and a rear-end LED group operate in reliable ranges of some performance characteristics.

DETAILED DESCRIPTION OF THE INVENTION

Below, the technical contents of the present invention will be described in detail in cooperation with the drawings.

Figure 1:
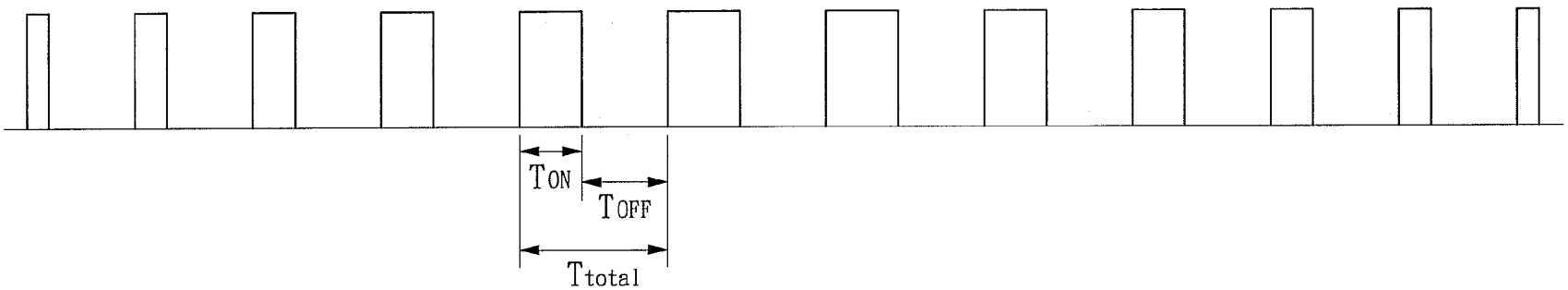
Fig. 1 PRIOR ART
FIG. 1 is a diagram showing the waveform output by a conventional power modulation/control circuit.
Figure 2:
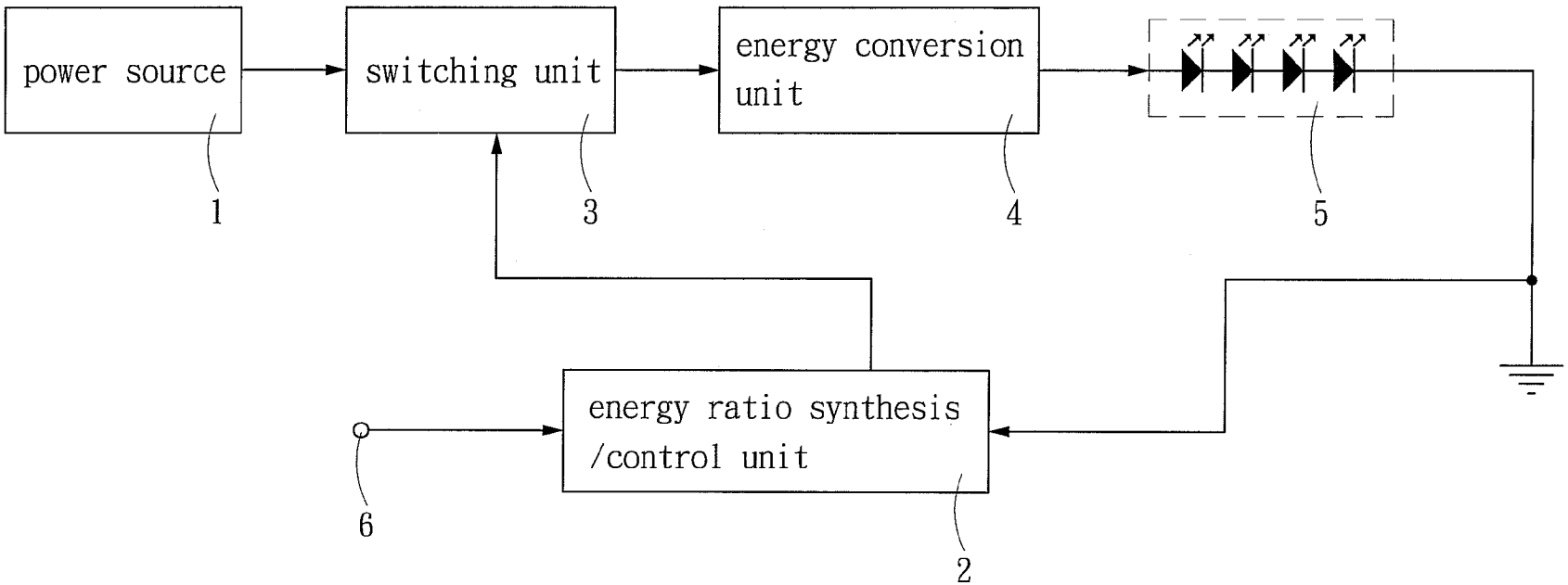
FIG. 2 is a block diagram schematically showing the circuit according to the present invention.
Figure 3:
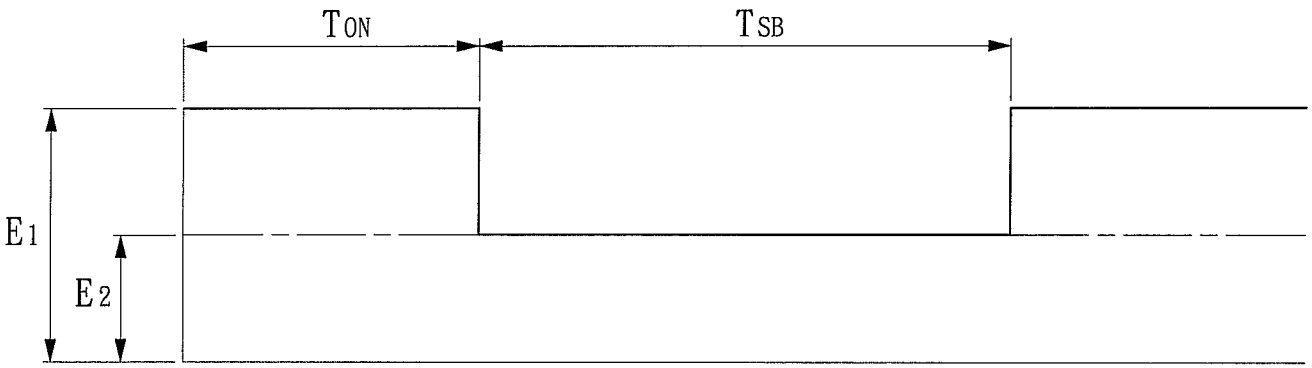
FIG. 3 to FIG. 7 are diagrams showing the waveforms of different-mode timing control signals according to different preferred embodiments of the present invention.

The present invention discloses a multi-modulation mode LED driving circuit, which controls an inverter to perform energy conversion to drive at least one LED. Refer to FIG. 2, a block diagram schematically showing the architecture of the present invention. The driving circuit of the present invention at least comprises: a power source 1, an energy ratio synthesis/control unit 2, a switching unit 3, an energy conversion unit 4 and an LED group 5. The power source 1 provides power. The energy ratio synthesis/control unit 2 receives a total-energy control signal 6, such as a signal indicating that the total energy is modulated from 10% to 100%, and generates a timing control signal $T_{ON}/T_{SB}$ containing an ON-Time $T_{ON}$ and a Standby-Time $T_{SB}$, wherein the sum of $T_{ON}$ and $T_{SB}$ is exactly $T_{total}$ in FIG. 1, and $T_{total}$ is the time interval of two timing cycles. The timing control signal $T_{ON}/T_{SB}$ enables the switching unit 3 to modulate the energy sent to the energy conversion unit 4. The energy ratio synthesis/control unit 2 generates the timing control signal $T_{ON}/T_{SB}$ according to the total-energy control signal 6 received in the input thereof. The present invention is characterized in that the energy ratio synthesis/control unit 2 controls the switching unit 3 to add a gradually varying-amplitude modulation energy in the Standby-Time $T_{SB}$ to generate a new EDR. In the start and end of the ON-Time $T_{ON}$/Standby-Time $T_{SB}$, the timing control signal $T_{ON}/T_{SB}$ have a gradually ascending interval and a gradually descending interval. Mixing two or more different cycles can generate high-reliability and wide-dynamical range modulation modes, which can effectively control some special energy conversion units 4 and make the energy conversion unit 4 and the rear-end LED group 5 operate in the reliable ranges of some performance characteristics. Refer to FIG. 3 for an embodiment of the present invention. In FIG. 3, a non-zero energy intensity $E_2$ is maintained in the Standby-Time $T_{SB}$, which can provide a standby mode function to greatly improve the modulation range of the LED driving circuit and maintain the overall operation of the energy conversion unit 4 not completely stopping. Thereby, the perceptible noise is inhibited. Further, via the different energy intensities in the ON-Time $T_{ON}$ and Standby-Time $T_{SB}$, the energy conversion unit 4 and the LED group 5 are effectively controlled, and the LED group 5 is effectively excited. When the amplitude of the output energy is to be changed, the duty width of the timing control signal $T_{ON}/T_{SB}$ is changed, but the frequency of the timing control signal $T_{ON}/T_{SB}$ is maintained. Thus, the bandpass-featured energy conversion unit 4 can work at a point of maximum efficiency. Changing the duty width can change the voltage that the energy conversion unit 4 outputs to the LED group 5 and can attain a regulation control function, which makes the product more reliable and efficient.

In a preferred embodiment is adopted a constant-frequency and varying duty width mode, wherein the frequency is maintained unchanged, but the duty width (i.e. the lengths of the ON-Time $T_{ON}$ and Standby-Time $T_{SB}$) is changed. As the frequency is fixed ($f_{ON}=f_{SB}$), the bandpass-featured energy conversion unit 4 can still operate at a point of maximum efficiency (usually in a better frequency range). Changing the duty width makes the energy conversion unit 4 output a smaller-amplitude square-wave voltage to vary the voltage driving the LED group 5 and thus attain a regulation controlling function. Alternatively, a varying-frequency ($f_{ON}\neq f_{SB}$) and constant duty width mode, or a varying-frequency and varying duty width, may also be adopted.

Figure 4:
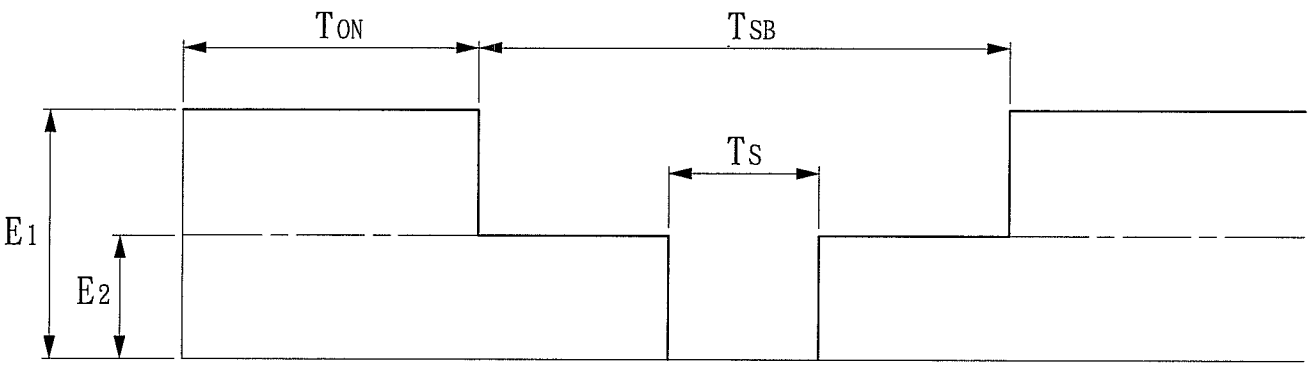

Refer to FIG. 4. In another preferred embodiment, a Stop-Time $T_S$ with a zero energy intensity ($E_S=0$) is added into the Standby-Time $T_{SB}$. Therefore, the present invention can achieve the same effect via various combinations of duty cycles of multiple modulation modes.

Figure 5:
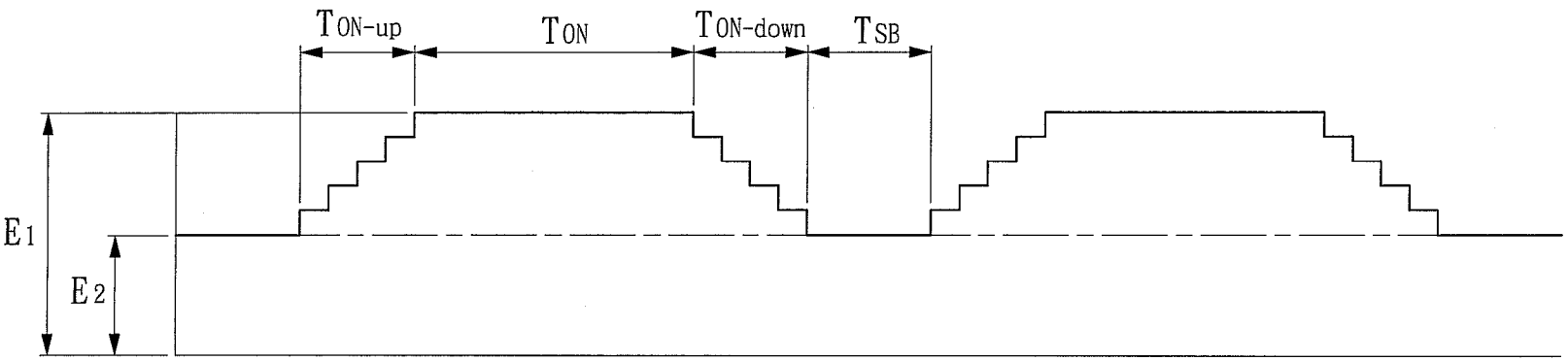
Figure 6:
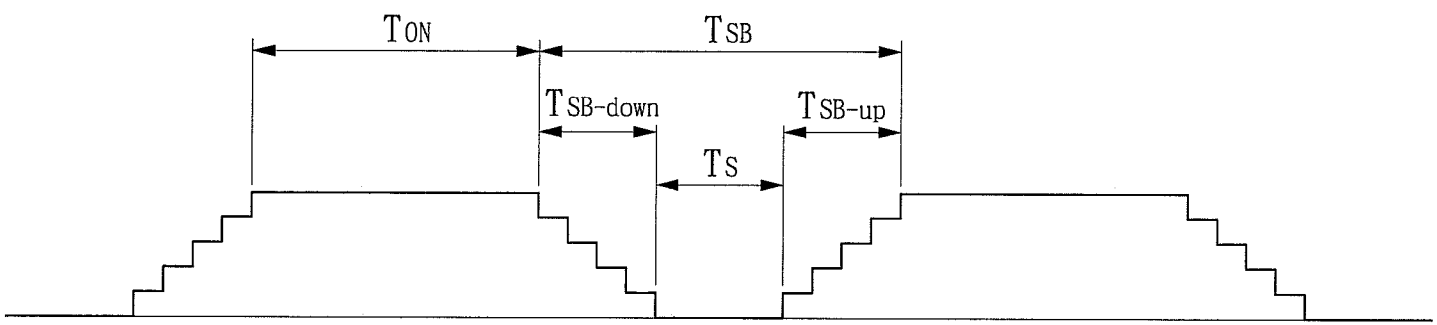

Refer to FIG. 5 for a variation of the embodiment shown in FIG. 3. In FIG. 5, a gradually-ascending interval $T_{ON\text{-}up}$ and a gradually-descending interval $T_{ON\text{-}down}$ are respectively added to the start and end of the ON-Time $T_{ON}$ and used to prevent the energy transition between $E_1$ and $E_2$ lest the EDR ($E_1/E_2$) being too high, wherein $E_1$ is the energy intensity in the ON-Time $T_{ON}$, and $E_2$ is the energy intensity in the Standby-Time $T_{SB}$. Refer to FIG. 6 for a variation of the embodiment shown in FIG. 4. In FIG. 6, a gradually-ascending interval $T_{ON\text{-}up}$ and a gradually-descending interval $T_{ON\text{-}down}$ are respectively added to the start and end of the ON-Time $T_{ON}$, and a gradually-descending interval $T_{SB\text{-}down}$ and a gradually-ascending interval $T_{SB\text{-}up}$ are respectively added to the start and end of Standby-Time $T_{SB}$.

Figure 7:
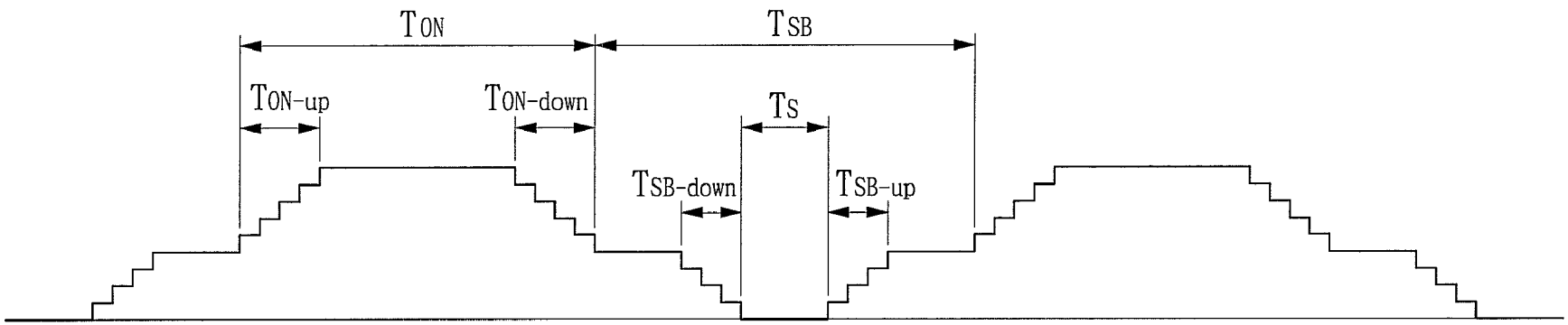

Refer to FIG. 7 for another preferred embodiment of the present invention. In FIG. 7, a gradually-descending interval $T_{SB\text{-}down}$ and a gradually-ascending interval $T_{SB\text{-}up}$ are respectively added to the start and end of Standby-Time $T_{SB}$, to prevent the energy transition between $E_1$ and $E_2$ lest the EDR ($E_1/E_2$) being too high.

In the present invention, a varying-amplitude modulation energy $E_2$ is added to the Stop-Time $T_S$, and thus $$EDR = \frac{E_1}{E_2} << \infty.$$

The total energy intensity is $$\frac{E_1 \times T_{ON} + E_2 \times T_{SB}}{Ttotal} = \frac{E_1 \times T_{ON}}{Ttotal},$$

wherein $T_{total}$ is the time interval of two timings.

The power sent to the LED group 5 is still maintained the same; therefore, a power regulation function is attained. Compared to the infinite EDR in the conventional technology, EDR has been greatly reduced in the present invention, and the aging of the LED group 5 is also decelerated.

The present invention can maintain the original dynamical peak energy and modulate the total energy simultaneously. Therefore, the present invention can expand the range of dynamical energy modulation without affecting the lifetime of the LED group 5, wherein the control signal may be of a constant-frequency and varying-duty width mode, a varying frequency and constant duty width mode, or a varying-frequency and varying duty width mode.

Refer to FIG. 5 again. The extended buffer interface timing control signal contains the gradually-descending interval $T_{ON\text{-}down}$ and the gradually-ascending interval $T_{ON\text{-}up}$ and they may have characteristics of constant frequency, varying frequency, constant duty width or varying duty width. The extended buffer interface timing control signal of the present invention can improve the energy transition between $E_1$ and $E_2$ lest EDR ($E_1/E_2$) be too high. The total energy in $T_{total}$—the time interval of two timings or the burst period can be calculated from the following equation:

$$\text{Total energy} = \frac{E_1 \times T_{ON} + E_{(TFI)} \times T_{FI} + E_2 \times T_{SB} + E_{(TRI)} \times T_{RI}}{T_{total}}$$

wherein $T_{ON}$ and $T_{SB}$ are the time intervals for allocating energy, and $E(_{TFI})\times T_{FI}+E(_{TRI})\times T_{RI}$ is the energy in the gradually-ascending intervals $T_{ON\text{-}up}$ and $T_{SB\text{-}up}$, and the gradually-descending intervals $T_{ON\text{-}down}$ and $T_{SB\text{-}down}$.

The preferred embodiments described above are only to exemplify the present invention but not to limit the scope of the present invention. Therefore, any equivalent modification or variation according to the spirit of the present invention is to be also included within the scope of the present invention.

What is claimed is:

1. A multi-modulation mode LED (Light Emitting Diode) driving circuit, which controls an inverter to perform energy conversion to drive at least one LED, wherein said driving circuit is modulated by a timing control signal containing an on time and a standby time, characterized in that:

said driving circuit adds a varying-amplitude modulation energy to said standby time, the start and end of said on time respectively have a gradually-ascending interval and a gradually-descending interval, and/or the start and end of said standby time respectively have a gradually-descending interval and a gradually-ascending interval, and two or more different cycles are mixed to generate high-reliability and wide-dynamical range modulation modes, which can effectively control some special energy conversion units and make said energy conversion unit and a rear-end LED group operate in reliable ranges of selected performance characteristics.

2. The multi-modulation mode LED driving circuit according to claim 1, wherein an energy ratio synthesis/control unit generates said timing control signal according to a total-energy control signal received by an input terminal thereof.

3. The multi-modulation mode LED driving circuit according to claim 1, wherein said timing control signal is of a constant-frequency and varying duty width mode.

4. The multi-modulation mode LED driving circuit according to claim 1, wherein said timing control signal is of a varying-frequency and constant duty width mode.

5. The multi-modulation mode LED driving circuit according to claim 1, wherein said timing control signal is of a varying-frequency and varying duty width mode.

6. The multi-modulation mode LED driving circuit according to claim 1, wherein said standby time contains a stop interval in which energy intensity is zero.

* * * * *